United States Patent [19]

Kolb et al.

[11] Patent Number: 4,466,377

[45] Date of Patent: Aug. 21, 1984

[54] DEVICE FOR FASTENING HANDLES, ESPECIALLY TO DOMESTIC AND GARDENING IMPLEMENTS

[75] Inventors: Walter Kolb, Betzdorf/Sieg; Helmut Weid, Niederdreisbach, both of Fed. Rep. of Germany

[73] Assignee: Wolfe-Geräte GmbH, Fed. Rep. of Germany

[21] Appl. No.: 346,194

[22] Filed: Feb. 5, 1982

[30] Foreign Application Priority Data

Feb. 6, 1981 [DE] Fed. Rep. of Germany ..... 3104228
Aug. 3, 1981 [DE] Fed. Rep. of Germany ..... 3130703

[51] Int. Cl.[3] ..... B25G 3/18

[52] U.S. Cl. ..... 16/114 R; 16/DIG. 24; 81/177 G; 403/329

[58] Field of Search ..... 16/110 R, 114 R, 110 A, 16/110.5, 111 R, DIG. 24, 114 A; 74/548, 554, 557; 403/329, 330, 332; 273/81.2; 81/177 R, 177 A, 177 G; 145/61 R

[56] References Cited

U.S. PATENT DOCUMENTS 2,313,858 3/1943 Armstrong .
2,472,184 6/1949 Anest .
2,501,940 3/1950 Hibbard ..... 16/114 A
2,546,387 3/1951 Coffing ..... 16/114 R
2,932,047 4/1960 Johnston .
4,162,132 7/1979 Kress et al. .

FOREIGN PATENT DOCUMENTS 1809097 1/1960 Austria .
1928499 9/1965 Austria .
2906154 8/1980 Fed. Rep. of Germany .
8027607 1/1981 Fed. Rep. of Germany .
1103112 10/1955 France .

*Primary Examiner*—Mark Rosenbaum
*Assistant Examiner*—Joseph M. Gorski
*Attorney, Agent, or Firm*—Ostrolenk, Faber, Gerb & Soffen

[57] ABSTRACT

A device for fastening handles, that consists of a connecting bushing (16) and an insert (18) that are attached to both the implement (86) and to the handle (10). The insert (18), which has a rectangular cross-section, is locked into the insertion opening in the connecting bushing when a catch (62) on a leaf spring (64) engages a hole (61) in the insert. The resulting positive lock can be disengaged by a push-button (48) or sliding sleeve. The push-button (48) rests against the end (74) of the leaf spring (64) and can be used to displace the catch (62) on the leaf spring from the hole (61). An axially elastic sleeve (84) between the end of the handle and the connecting piece (20) compensates for tolerances. The circular handle merges gradually into an oval or ellipse toward the connecting piece (20).

10 Claims, 10 Drawing Figures

DEVICE FOR FASTENING HANDLES, ESPECIALLY TO DOMESTIC AND GARDENING IMPLEMENTS

The invention is a device for fastening handles, especially to domestic and gardening implements, in the form of a plug-type connection consisting of a bushing mounted on the end of the handle and an insert mounted on a connecting piece on the implement and with a lock mechanism that is used to lock the bushing and the insert positively and axially together into an operating position and that can be unlocked by hand.

Such handle-fastening devices, many embodiments of which are known, make it possible to employ a large number of implements in relation to only one or to only a few handles, of different lengths for example. This is economical because a separate handle will not have to be purchased for each implement. The implements will also be easier to store because they will take up less space without a handle.

The invention is intended as an improved plug-type connection that is simpler in design than presently available connections and that will simplify fastening the implement to, and releasing it from, the handle and ensure a tight and non-rotating fit when the two elements are fastened together.

This intention is achieved by utilizing a plug-type connection consisting of a bushing mounted on the end of the handle and an insert mounted on a connecting piece on the implement together with a manually releaseable lock mechanism to hold the bushing and insert together positively and axially in an operating position. The lock mechanism is automatically engaged by a spring when the insert reaches a predetermined terminal position. Force applied against the spring is used to release the lock mechanism.

One preferred embodiment of the invention incorporates a release in the form of a button that is easy to press and that thereupon slides radially into the handle and disengages the lock mechanism. Other types of release mechanism, accessible at the operator end of the handle and connected by a rod to a bolt in the connection for instance, can also be employed. Sliding or rotating sleeves can also be provided to release the connection. Still, the push-button system seems to be the simplest and best.

A leaf spring that serves as a catch and that directly engages with the lock-mechanism opening in one embodiment of the invention eliminates problems involved in fastening the connection crookedly, etc.

Another advantage of this embodiment is that the function of the implement will not be impaired by any dirt that gets into the bushing through the insertion opening. Such dirt will fall into the space enclosed by the handle tube, will be thrust away by the surfaces that participate when the two elements are screwed together, and will be easy to remove later by knocking on the handle.

The subsidiary claims disclose other practical embodiments of the invention.

Figure 1:
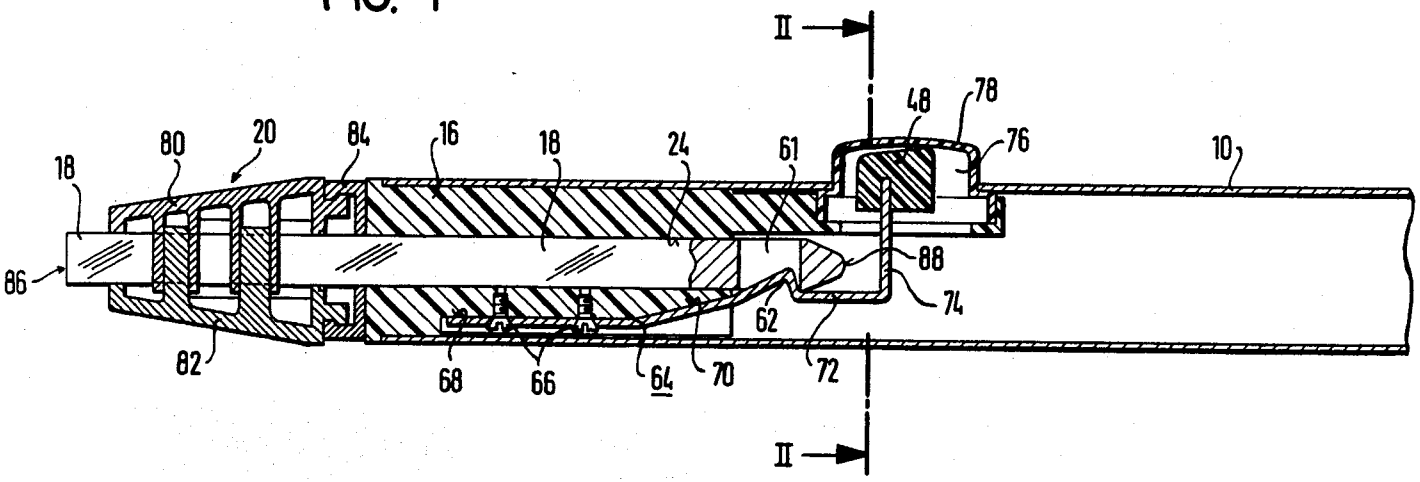
Figure 2:
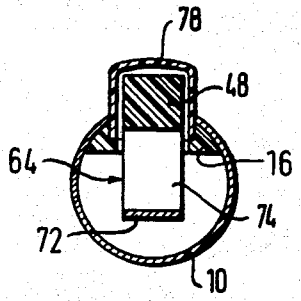
Figure 3:
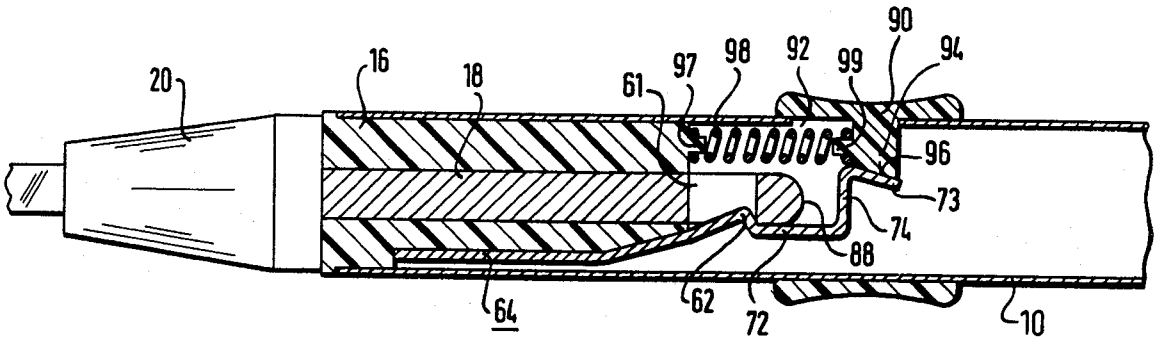
Figure 4:
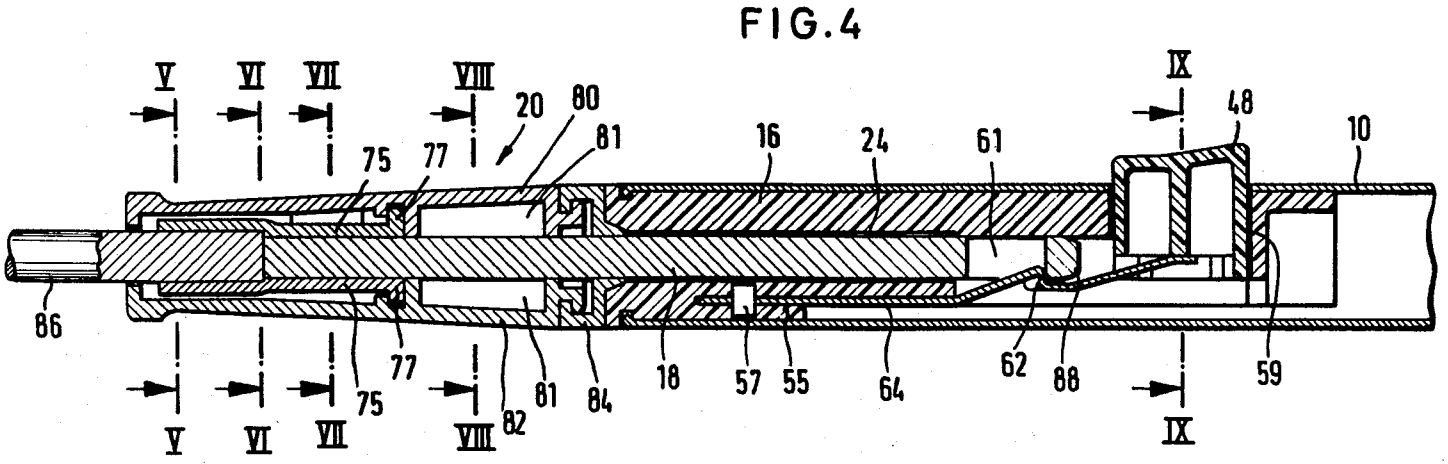
Figure 9:
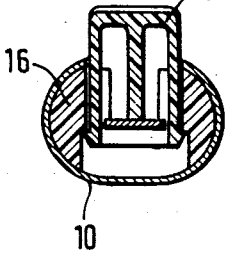
Figure 10:
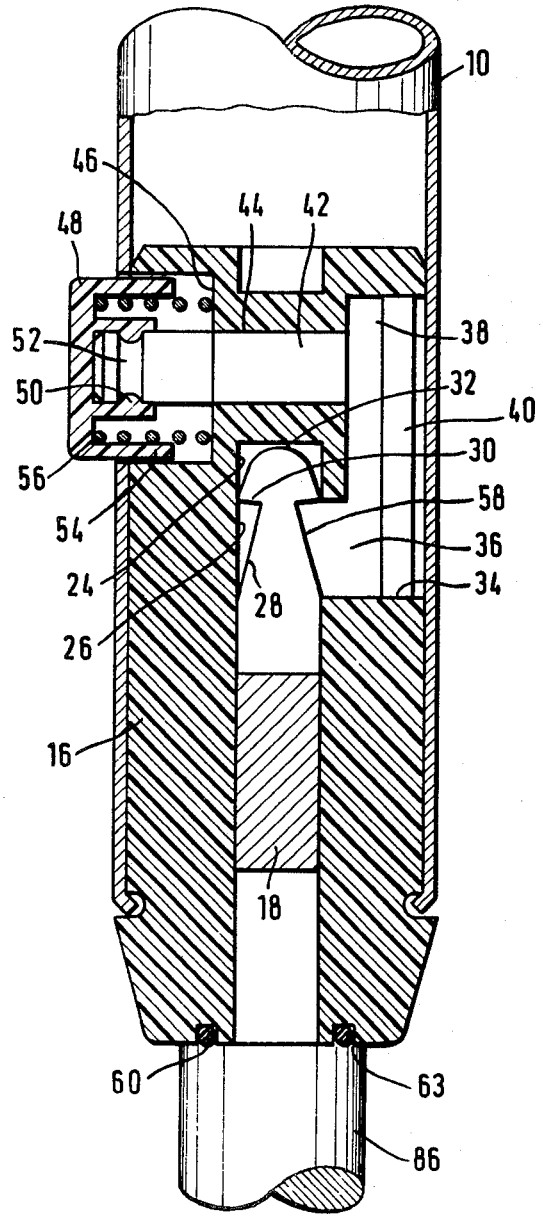

Various embodiments of the invention will now be specified with reference to the drawings, in which FIG. 1 is a longitudinal section through a handle-fastening device designed in accordance with the invention, FIG. 2 a section along Line II-II in FIG. 1, FIG. 3 a longitudinal section through another embodiment of the handle-fastening device, FIG. 4 a longitudinal section through a variation, FIGS. 5 through 9 sections along the lines V-V through IX-IX in FIG. 4, and FIG. 10 a section through another embodiment.

In the embodiment illustrated in FIGS. 1 and 2, a plastic connecting bushing 16 is fixed in one end of a tubular handle 10. The section of the connecting bushing in this particular embodiment is dodecagonal to keep it from rotating, once inserted into the handle. The section of the insertion opening 24 in connecting bushing 16 is rectangular and matches that of an insert 18 that is fixed to the connecting pieces 20 of an implement, not shown. This enables both elements of the plug-type connection to be connected in two different positions at a 180° angle to each other. The inserted end of insert 18 has a hole 61 with a rectangular or square section. When the two elements are connected, a catch 62 on a leaf spring 64 that is fastened at one end with screws 66 to a flat area 68 on connecting bushing 16 fits into hole 61. The catch 62 includes a cam surface 100 and a catch surface 102. Flat area 68 merges into a bevel 70 that extends up to hole 61. Beyond catch 62 leaf spring 64 forms an L 72, 74, one arm 74 of which extends across the axis of the connection. A push-button 48 is mounted on arm 74, projects outwards through an opening 76 in the handle, and is covered with a protective cap 78 of elastic material that seals opening 76.

Connecting piece 20 consists of an upper socket half 80 and a lower socket half 82 that are held together by a sleeve 84 on one end and fastened to connecting insert 18. Only the insert of implement 86 is represented.

When insert 18 is inserted into insertion opening 24, the conical or rounded end or steering surface 88 of insert 18 engages cam surface 100 which laterally displaces leaf spring 64 until the two elements are completely together. In this position, the catch 62 on spring 64 will automatically enter hole 61 and catch surface 102 will abut the front end of the hole 61 so as to secure the connection. Sleeve 84, which is made of an elastic material, will elastically support connecting piece 20 axially to compensate for manufacturing tolerances and ensure a seating that is free from play. It will be simple to release the plug-type connection by pressing down on push-button 48 and sliding insert 18 out axially.

The embodiment illustrated in FIG. 3 differs from that in FIGS. 1 and 2 in that it has a sliding sleeve 90 instead of push-button 48. Sleeve 90, which slides up and down tubular handle 10 has a projection 94 with a slanting surface 96 that extends radially into the handle through a slot 92. A helical compression spring 98 is mounted inside and parallel to the axis of the handle and over pins 97 and 98, which project, one from connecting bushing 16 and the other from the front of projection 94. Arm 74 of leaf spring 64 continues into an extension 73 that lies at an angle to the axis and that fits the slanting surface 96 of projection 94.

When sleeve 90 is slid against the force of spring 98, catch 62 on spring 64 is forced out of hole 61 in insert 18, which can then be easily withdrawn along with connecting piece 20 and the implement. When sliding sleeve 90 is released, spring 98 will force it back into the initial position depicted in FIG. 3. When an insert 18 is inserted into the bushing, its rounded end 88 will again radially displace spring 98, and catch 62 will again engage with hole 61 when insert 18 is all the way in and will positively lock the plug-type connection.

The embodiment illustrated in FIGS. 4 through 9 has the same locking system as that in FIGS. 1 and 2. It differs in that leaf spring 64 is mounted in a slit 55 in connecting bushing 16 and secured there by a rivet 57. Push-button 48 is not covered by a protective cap and can be pushed directly into a recess in the handle or into a guide shaft 59 in bushing 16.

Figure 8:
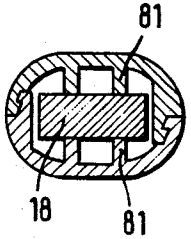
Figure 7:
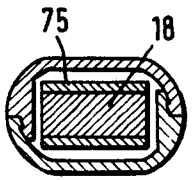
Figure 6:
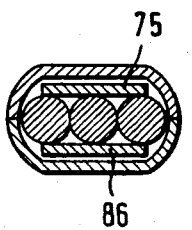
Figure 5:
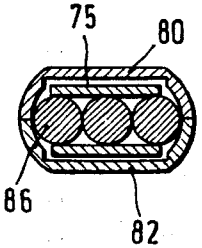

As will be evident from FIGS. 5 through 9, the cross-section of handle 10 is circular and merges gradually into an ellipse in the neighborhood of connecting piece 20. Implement 86 is connected to insert 18 by two plates 75 welded on one end to the implement 86 and on the other to insert 18. Thus, the implement can have three round inserts as a connection, as shown in FIGS. 5 and 6. Insert 18 in FIG. 8 is supported inside the two socket halves 80 and 82 by longitudinal ribs 81.

Plates 75 are anchored in upper and lower socket halves 80 and 82 by flange 77, which points radially outward. In this embodiment as well, sleeve 84 supports connecting piece 20 elastically and axially.

The function of the embodiment illustrated in FIG. 10 is similar to that of those described above. Similar elements are indexed with the same numbers and will not be described in detail. In this embodiment, insert 18 has recesses 26 in two of its opposing and rectangular sides. One flank 28 of each recess 26 slopes axially inward toward the inserted end of insert 18 and the other 30 emerges at a right angle to the axis of insert 18 and forms a catch. The inserted end of insert 18 has a convex head 32.

Connecting bushing 16 has a radial perforation 34 that opens into insertion opening 24 and guides a radially displaceable bolt 36 that projects inward through one side wall of opening 24 and falls into place behind catch 30 when insert 18 is all the way in to prevent the insert from being withdrawn. Bolt 36 is fixed to an arm 38 that extends axially and that moves radially in a recess 40 that ends in perforation 34 in bushing 16. A radial plunger 42 is mounted on arm 38 and slides back and forth in a radial guide shaft 44 that runs through bushing 16 at an axial interval from the bottom of insertion opening 24. The part of shaft 44 that faces away from recess 40 is wider and has a shoulder 46.

Push-button 48 projects out of handle 10 and has a resilient bead inside it that secures it to plunger 42 by snapping into an annular groove 52 around the outer end of the plunger. The wall 54 of push-button 48 fits into the wider part of shaft 44. There is a helical compression spring 56 in shaft 44 between shoulder 46 and the top of push button 48 that tends to push plunger 42 and hence arm 38 and bolt 36 to the left in FIG. 2 into the locked position. Pushing in push-button 48 will disengage the lock mechanism by releasing bolt 36 from catch 30 on insert 18, and connecting piece 20 can be extracted axially from connecting bushing 16.

To connect one implement or another that has the same type of connecting piece 20 to handle 10, insert 18 is simply inserted firmly in insertion opening 24. Convex head 32 will displace bolt 36, which has a slanting surface 58 that mates with one of the flanks 28 of a recess 26 on insert 18. When bolt 36 engages catch 30, it will come to rest under the influence of spring 36 and will automatically positively lock the connection axially and against torsion.

An annular surface at the implement end of connection bushing 16 has an annular groove that accepts an elastic gasket 60 that fits against an annular surface 63 on connecting piece 20 to compensate for axial tolerance and simultaneously seal the inside of the bushing from the environment. Gasket 60 thus corresponds to sleeve 84 in the embodiment illustrated in FIGS. 1 through 4.

We claim:

1. Handling fastening device comprising:

a handle including an axially extending insert opening of non-circular cross-section that extends forwardly from an open rear end of said handle;

an insert having a cross-section corresponding to the non-circular cross-section of said opening, said insert including a steering surface at a forward end thereof and a locking recess in close proximity to said steering surface and rearward thereof;

an axially extending leaf spring located within said handle, said spring having its rear end secured to said handle, an intermediate portion defining a cam surface and disposed obliquely with respect to a longitudinal axis of said insert opening, a locking catch surface disposed forward of said cam surface and forming an angle with respect to said cam surface, and a releasing portion forward of said catch surface;

said steering surface of said insert and said cam surface of said spring cooperating in such a manner that as said insert is moved forwardly in said insert opening, said cam surface is engaged by said steering surface and causes a forward portion of said spring to deflect radially with respect to said axis and to thereby stress said spring until said catch surface and said recess are aligned, at which point said catch surface falls into said recess to lock said insert against rearward movement with respect to said insert opening;

a manually operable control knob movably mounted on said handle for operatively engaging said releasing portion to deflect said spring radially in response to movement of said knob relative to said handle thereby removing said catch surface from said recess to permit said insert to be withdrawn from said recess;

said catch surface and said cam surface being disposed entirely within said handle.

2. Handle fastening device as set forth in claim 1 in which the knob is affixed to the releasing portion at an angled end section thereof.

3. Handle fastening device as set forth in claim 2 in which said handle is provided with an aperture with which said knob is aligned, and wherein said handle fastening device further includes a depressible cap closing said aperture and engaging said knob to apply releasing forces thereto.

4. Handle fastening device as set forth in claim 1 in which the knob is slidable on said handle and guided for axial movement, and further including cam means having cooperating engaging surfaces on said knob and said releasing portion, respectively, to deflect said spring radially upon movement of said knob axially in a first direction thereby removing said catch surface from said recess, and biasing means urging said knob in a second direction opposite to said first direction.

5. Handle fastening device as set forth in claim 1 in which the non-circular cross-section of the insert opening is rectangular and said recess traverses said insert extending between opposite surfaces thereof.

6. Handle fastening device as set forth in claim 1 also including a connecting section on said insert, said connecting section including first and second interlocking pieces, and elastic means for maintaining said pieces in operative engagement.

7. Handle fastening device as set forth in claim 6 in which the elastic means is compressed against a rearward portion of said handle to take up axial play between said handle and said insert.

8. Handle fastening device as set forth in claim 1 in which said handle includes a hollow tube member open at its rear end and an elongated bushing disposed within said hollow tube member at its said rear end, said insert opening being in said bushing, said bushing having a flat outer surface portion to which said spring is secured.

9. Handle fastening device as set forth in claim 1 in which said handle includes a hollow tube member open at its rear end and an elongated bushing disposed within said handle at its said rear end, said insert opening being in said bushing, a connecting section on said insert, said connecting section and said bushing each have a cross-section that is oval-like.

10. Handle fastening device as set forth in claim 1 wherein said insert includes first and second sections coupled to each other by first and second overlapping plates, and further comprising a hollow connecting section on said insert, said plates having flange sections that interlock with internal formations of said connecting section to fasten said plates to said connecting section.

* * * * *